United States Patent [19]

Hodek et al.

[11] Patent Number: 4,807,419

[45] Date of Patent: Feb. 28, 1989

[54] MULTIPLE PANE UNIT HAVING A FLEXIBLE SPACING AND SEALING ASSEMBLY

[75] Inventors: Robert B. Hodek, Gibsonia; James A. Meier, Bradford Woods; James E. Jones, Lower Burrell; Jerome A. Seiner, Pittsburgh, all of Pa.

[73] Assignee: PPG Industries, Inc., Pittsburgh, Pa.

[21] Appl. No.: 30,012

[22] Filed: Mar. 25, 1987

[51] Int. Cl.[4] ..... E04C 2/54

[52] U.S. Cl. ..... 52/788; 52/172; 52/202

[58] Field of Search ..... 52/172, 788

[56] References Cited

U.S. PATENT DOCUMENTS

| | | | |
|---|---|---|---|
| 3,277,593 | 1/1966 | Woelk | 156/104 |
| 3,333,015 | 7/1967 | Burke, Jr. et al. | 260/680 |
| 3,669,785 | 6/1972 | Bowser et al. | 156/109 |
| 3,673,168 | 6/1972 | Burke, Jr. et al. | 260/94.2 ER |
| 3,758,996 | 9/1973 | Bowser | 52/172 |
| 3,791,910 | 2/1974 | Bowser | 161/45 |
| 4,036,360 | 7/1977 | Deffeyes | 426/127 |
| 4,063,002 | 12/1977 | Wilson, Jr. | 428/411 |
| 4,109,431 | 8/1978 | Mazzoni et al. | 52/172 |
| 4,153,594 | 5/1979 | Wilson, Jr. | 260/31.8 R |
| 4,205,104 | 5/1980 | Chenel | 428/34 |
| 4,226,063 | 10/1980 | Chenel | 52/172 |
| 4,233,790 | 11/1980 | Meadows | 52/202 X |
| 4,333,284 | 6/1982 | Meadows | 52/202 X |
| 4,380,140 | 4/1983 | Abbott | 52/202 |
| 4,429,509 | 2/1984 | Vachet et al. | 52/788 |
| 4,622,249 | 11/1986 | Bowser | 428/34 |

FOREIGN PATENT DOCUMENTS 0916852 10/1986 European Pat. Off. .

*Primary Examiner*—David A. Scherbel
*Assistant Examiner*—Creighton Smith
*Attorney, Agent, or Firm*—Linda Pingitore

[57] ABSTRACT

An improved multiple glazed unit including a pair of glass sheets maintained in spaced-apart relationship to each other by a spacer element to provide an airspace therebetween and a sealing element to hermetically seal the airspace, is characterized by a spacer element containing a dehydrating material and an unplasticized polymeric material which is the reaction product of a polyisocyanate and an active hydrogen containing material; and a sealing element containing an unplasticized polymeric material which is the reaction product of a polyisocyanate and an active hydrogen containing material; the polymeric material of the spacer element having a moisture vapor transmission rating which is greater than that of the polymeric material of the sealing element.

19 Claims, 2 Drawing Sheets

MULTIPLE PANE UNIT HAVING A FLEXIBLE SPACING AND SEALING ASSEMBLY

BACKGROUND OF THE INVENTION

The present invention relates to multiple pane window units having a non-metal, flexible, spacing and sealing assembly.

Multiple pane window units generally comprise a pair of glass sheets maintained in spaced-apart relationship to each other by a spacing and sealing assembly extending around the marginal periphery of the inner, facing surfaces of the sheets, to define a substantially hermetically sealed, insulating air space between the sheets. The spacing and sealing assembly generally comprises an inner spacer-dehydrator element extending around the marginal periphery of the inside facing surfaces of the glass sheets and an outer sealing element extending around the outside periphery of the inner spacer-dehydrator element.

In one art recognized form of multiple pane window construction, the inner spacer-dehydrator element comprises a hollow metal spacer element generally adhered by a hot melt adhesive composition to the marginal periphery of the inside, facing surfaces of the sheets to provide a primary hermetic seal. The metal spacer element is generally tubular in shape and filled with a desiccant material, which is put in communication with the insulating air space to absorb moisture and thereby enhance the performance and durability of the unit. The outer sealing element generally comprises a resilient, moisture resistant strip placed around the marginal periphery of the glass sheets and the outer periphery of the inner spacer-dehydrator element to provide a secondary hermetic seal. A drawback of these art recognized multiple pane window units having a metal spacer element is the cost of fabricating the metal spacer element.

Although multiple pane units having a flexible spacing and sealing assembly are known, improvements to enhance various aspects are desirable.

SUMMARY OF THE INVENTION

In accordance with the present invention, in a multiple glazed unit comprising a pair of glass sheets maintained in spaced-apart relationship to each other by a spacer element to provide a gas space therebetween and a sealing element to hermetically seal the gas space, the improvement comprises a spacer element comprising a dehydrating material and an unplasticized polymeric material which is the reaction product of a polyisocyanate and an active hydrogen containing material, and a sealing element comprising an unplasticized polymeric material which is the reaction product of a polyisocyanate and an active hydrogen containing material; the polymeric material of the spacer element having a moisture vapor transmission rate which is greater than that of the polymeric material of the sealing element.

DETAILED DESCRIPTION OF THE INVENTION

In the improved multiple glazed unit of the present invention, both the spacer and sealing elements are non-metal, polymeric materials. The improvement in the glazed unit comprises a spacer element comprising a dehydrating material and an unplasticized polymeric material which is the reaction product of a polyisocyanate and an active hydrogen containing material and a sealing element comprising an unplasticized polymeric material which is the reaction product of a polyisocyanate and an active hydrogen containing material. The polymeric material of the spacer element of the unit should have a moisture vapor transmission rate which is greater than that of the polymeric material of the sealing element of the unit.

Figure 1:
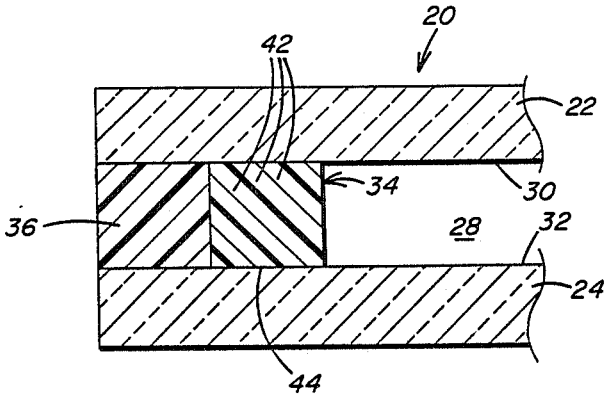
FIG. 1 fragmentary, transverse cross-sectional view of a preferred embodiment of the multiple pane unit of this invention.

Referring now to FIG. 1, there can be seen a multiple pane unit 20 comprising a pair of sheets 22, 24 maintained in preferably parallel, spaced-apart relationship to each other by a spacer element 34 and a sealing element 36, defining a substantially hermetically sealed, insulating gas space 28 between the sheets 22, 24. Typically, the insulating space is an airspace, although various other gases can be used in place of air. Therefore, for ease of description the insulating space will be referred to herein as an airspace. The sheets 22, 24 can be constructed of a variety of materials, e.g., wood, metal, plastic, or glass. The sheets 22, 24 can be transparent, translucent, designed or opaque. The sheets 22, 24 are preferably glass sheets, e.g. float glass sheets. For ease of description the following discussion will refer to glass sheets, although the invention is not limited thereto. The glass sheets 22, 24 can be of any desired shape or configuration. Moreover, the glass sheets 22, 24 can be laminated, tinted, coated, heat or chemically strengthened, or have any other desired strength, aesthetic, optical and/or solar control properties. A particularly durable, energy efficient and aesthetically appealing, high performance coating which can be utilized with the window unit 20 of this invention is a heat and light reflective coating, that is, a solar control coating. Multi-glazed windows having such a coating are sold by PPG Industries, Inc. under the registered trademarks SUNGATE®, SOLARCOOL® AND SOLARBAN®. The solar control coatings are usually applied to either or both of the inner, facing surfaces 30, 32 of the sheets 22, 24 respectively. The number, type, or other characteristics of the sheets employed in the practice of this invention can vary widely and therefore do not limit the invention.

The spacer element 34 of the claimed multiple glazed unit is preferably self adhered to the marginal periphery of the inner, facing surfaces of the glass sheets and disposed in vapor communication with the insulating airspace. The spacer element is characterized by the property of being adequately water vapor permeable, that is, that it is characterized by a moisture vapor permeability or transmission rate sufficient to maintain low water content in the airspace. Preferably, the spacer has a moisture vapor transmission rate of at least about 1 gram/square meter day per millimeter. The moisture vapor transmission rate is determined according to ASTM F-372-78 and the results standardized for a one millimeter thick sample. Hereinafter in this application the moisture vapor transmission rate will be expressed as gram millimeter/square meter day (gmm/dm$^2$). More preferably the moisture vapor transmission rate is at least 2 gmm/dm$^2$ and most preferably at least 4 gmm/dm$^2$. As has been mentioned above, the spacer element is comprised of a dehydrator material and an unplasticized polymeric material which is the reaction product of a polyisocyanate and an active hydrogen containing material. These components will be discussed in detail below.

The spacer element of the present invention can be formulated so as to provide the requisite adhesive structural bond strength sufficient to hold the glass sheets in substantially fixed, spaced-apart relation to each other without allowing substantial variance in the thickness of the insulating airspace. Preferably, the spacer element has an adhesive structural bond strength characterized by a shear strength of at least about 10 pounds per square inch as determined by ASTM D-1002; a tensile bond strength of at least about 20 pounds per square inch; and an elongation at break of at least about 2 percent as determined by ASTM D-952. More preferably, the spacer element has an adhesive structural bond strength characterized by a shear strength of at least about 40 pounds per square inch; a tensile bond strength of at least about 40 pounds per square inch; and an elongation at break of at least about 5 percent. It is preferred that the spacer element have these minimum adhesive structural strength properties in order to withstand a variety of stresses to which the multiple glazed unit may be subjected during storage, handling, transportation, and/or use. For example, chemical stresses, wind loads, static loads or thermal loads. These stresses may cause disuniformities in the thickness of the airspace which can lead to localized stresses in the spacer and sealing elements. Eventually these stresses can cause failure of the multiple glazed unit.

The sealing element 36 of the claimed multiple glazed unit is preferably adhered to the marginal periphery of the inner, facing surfaces of the glass sheets. The sealing element is characterized by the property of being substantially moisture imperveous, that is, it is characterized by a moisture vapor permeability or transmission rate of no greater than about 10 gmm/dm$^2$. Preferably the water vapor permeability of the sealing element is no greater than about 5 gmm/dm$^2$.

The sealing element comprises an unplasticized polymeric material which is the reaction product of a polyisocyanate and an active hydrogen containing material. In addition, the sealing element can be formulated in order to provide the requisite adhesive structural bond strength sufficient to hold the sheets in substantially fixed, spaced-apart relation to each other without allowing substantial variance in the thickness of the insulating airspace. Preferably, the sealing element has an adhesive structural bond strength characterized by a shear strength of at least about 5 pounds per square inch as determined by ASTM D-1002; a tensile bond strength of at least about 20 pounds per square inch; and an elongation at break of at least about 2 percent as determined by ASTM D-952. The sealing element more preferably has an adhesive structural bond strength characterized by a shear strength of at least about 15 pounds per square inch; a tensile bond strength of at least about 40 pounds per square inch; and an elongation at break of at least about 5 percent. It is preferred that the sealing element have these minimum adhesive structural strength properties in order to withstand a variety of stresses to which the unit may be subjected during storage, handling, transportation and/or use. These stresses are similar to those enumerated above for the spacer element. As was mentioned above with respect to the spacer element, these stresses can cause disuniformities in the thickness of the airspace which in turn can lead to localized stresses in the spacer and sealing elements which can eventually cause failure of the unit.

It should be understood that the adhesive structural bond strength for the glazed unit can be provided by either the spacer element, the sealing element or both elements. In a preferred embodiment, both the spacer and the sealing elements have the above described minimum adhesive structural bonding strength properties. This maximizes the probability that the thickness of the insulating airspace will be maintained uniformly around the entire perimeter of the glazed unit during the life of the unit. Moreover, when structural properties are present in both he spacer and sealing element, any loads which may be transmitted to the spacer and sealing elements are more evenly distributed thus improving the performance and useful life of the unit.

In a further preferred embodiment of the present invention the spacer element and sealing element are formulated such that the spacer element can alone provide the requisite adhesive bonding strength to maintain the glass sheets in spaced apart relationship to each other without permitting a substantial variance in the thickness of the airspace.

The spacer element of the claimed multiple glazed unit also comprises a dehydrator material which is represented by the dots 42 in FIG. 1. The dehydrator material can also be termed a desiccant material. The desiccant material serves to keep the airspace substantially moisture free and thus prevents hazing or fogging of the multiple glazed unit and permanent moisture staining of the inner, facing surfaces of the glass sheets. The desiccant material preferably should be capable of absorbing from the atmosphere in excess of 5 to 10 percent of its weight, more preferably in excess of 10 percent of its weight, in moisture. Also, the desiccant material preferably should have sufficient communication with the airspace so that moisture present within the airspace is effectively absorbed by the desiccant material.

Preferably the desiccant material is uniformly dispersed throughout the unplasticized polymeric material 44 of the spacer element; although, if the desiccant material is non-uniformly dispersed this is not deterimental. The suitable desiccant materials for use in the present invention include synthetically produced crystalline metal alumina silicates or crystalline zeolites. One example of a synthetically produced crystalline zeolite that is particularly useful in the present invention is covered by U.S. Pat. Nos. 2,882,243 and 2,882,244. This crystalline zeolite is Linde Molecular Sieve 13X®, in powdered form, produced by Union Carbide Corporation, or Molecular Sieve 4-A® or Molecular Sieve 3-A® also produced by Union Carbide Corporation. A variety of other desiccant materials, preferably in pulverulent form or capable of being converted to pulverulent form, can also be utilized such as anhydrous calcium sulfate, activated alumina, silica gel and the like.

The spacer element 34 and the sealing element 36 may be applied to the sheets 22, 24 in any convenient manner. For example, any of the methods or processes taught in U.S. Pat. Nos. 3,882,172; 3,876,489; 4,145,237; 4,088,522; 4,085,238; 4,186,685; 4,014,733; 4,234,372; or 4,295,914, which are herein incorporated by reference, or any other convenient method or process may be employed to apply the spacer and sealing elements and assemble the window unit. As an illustration, the spacer element 34 material may be fed through an extrusion nozzle (not shown), and relative motion imparted to the extrusion nozzle and one of the glass sheets 22 or 24 to apply the extruded material (i.e., extrudate) in filament or other desired form, onto the marginal periphery of the sheet 22 or 24. The sheet 22 or 24 having the extrudate applied thereto is then aligned with a superimposed second sheet 24 or 22. The two sheets 22 and 24 are then pressed together and held in spaced relation by the extruded ribbon of spacer element 34. Thereafter, the sealing element is extruded to seal the airspace 28.

In one embodiment, the spacer and the sealing element can be simultaneously coextruded between two glass sheets held in a spaced-apart relationship.

Figure 2:
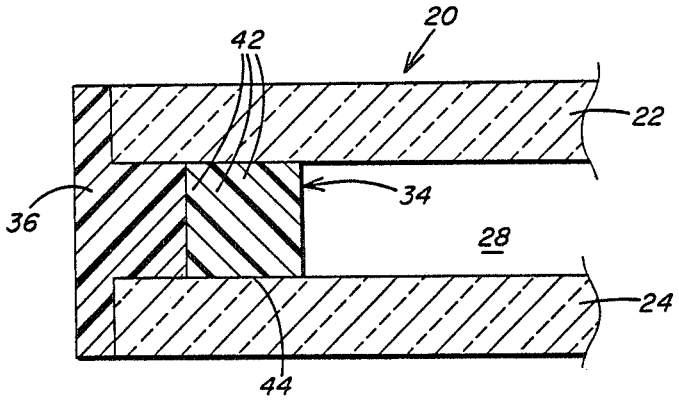
FIG. 2 fragmentary, transverse cross-sectional view of an alternative embodiment of the multiple pane unit of this invention.

As is indicated in FIG. 2, the sealing element can be applied so as to cover the peripheral edges of the glass sheets. This is not necessary, however, and the peripheral edges can be exposed as is indicated in FIG. 1.

The unplasticized polymeric material of the spacer and sealing elements is the reaction product of a polyisocyanate and an active hydrogen containing material. For example, the polymeric material can be a polyurethane, polyurea, poly(urethane-urea), polythiocarbamate or mixtures thereof depending upon the choice of active hydrogen containing material. By "unplasticized" is meant that the material is essentially free of externally added plasticizing additives. The preferred polymeric material for the sealer is a polyurethane and the preferred polymeric material for the spacer is a poly(urethane-urea).

The polyisocyanate reactant for use in the practice of the present invention is any material which contains two or more isocyanate groups in the molecule. The polyisocyanate can be an aliphatic or aromatic polyisocyanate including, for example, cycloaliphatic, aryl, aralkyl, and alkaryl polyisocyanates or mixtures thereof. Some monisocyanate can also be present if desired. As will be explained in detail below, it can also be a higher molecular weight adduct or reaction product prepared by reacting an excess of a polyisocyanate with a polyfunctional compound containing active hydrogen, such adducts or reaction products generally are referred to as prepolymers.

Examples of aliphatic polyisocyanates which can be used are: ethylene diisocyanate, trimethylene diisocyanate, tetramethylene diisocyanate, other alkylene diisocyanates, such as propylene-1,2-diisocyanate, butylene-1,2-diisocyanate, butlylene-1,3-diisocyanate, butylene-2,3-diisocyanate, alkylidene diisocyanates, such as ethylidene diisocyanate, butylidene diisocyanate cycloalkylene diisocyanates, such as cyclopentylene,-1,3-diisocyanate, cyclohexylene-1,4-diisocyanate, 4,4'-diisocyanato bis(cyclohexyl)methane; p-phsnylene-2,2'-bis(ethyl isocyanate), p-phenylene-4,4'-bis (butyl isocyanate); m-phenylene-2,2'-bis(ethyl isocyanate); 1,4-naphthalene-2,2'-bis(ethyl isocyanate); 4,4'-diphenylene-2,2'-bis(ethyl isocyanate); 4,4'-diphenylene ether-2,2'-bis(ethyl isocyanate); tris(2,2',2''-ethyl isocyanate benzene); 5-chloro phenylene-1,3-bis(propyl-3-isocyanate); 5-methoxy phenylene-1,3-bis(propyl-3-isocyanate); 5-cyano phenylene-1,3-bis(propyl-3-isocyanate); and 5-methyl phenylene-1,3-bis(propyl-3-isocyanate).

Examples of aromatic polyisocyanates which can be used include: toluene diisocyanate; m-phenylene diisocyanate; p-phenylene diisocyanate; 1-methyl-2,4-phenylene diisocyanate; naphthylene-1,4-diisocyanate; diphenylene-4,4'-diisocyanate; xylylene-1,4-diisocyanate; xylylene-1,3-diisocyanate; and 4,4'-diphenylenemethane diisocyanate.

Preferably the polyisocyanate used in the preparation of the spacer element is an aliphatic polyisocyanate.

Examples of preferred active hydrogen containing materials include polymers containing hydroxyl functionality, amine functionality, mercaptan functionality, or mixtures of these functional groups. Suitable materials include polyester polyols, polyether polyols, amine functional polyethers, mercapto functional polyethers, and mercapto functional polysulfides.

Examples of suitable amine functional polyethers include polyoxyethylene polyamines such as polyoxyethylene diamine and polyoxypropylene polyamines such as polyoxypropylene diamine. Other examples of amino functional materials include amino functional polybutadiene.

Examples of suitable mercapto functional polysulfides include the polysulfide polymers commercially available from Morton Thiokol under the designation LP.

Examples of polyether polyols are polyalkylene ether polyols which include those having the following structural formula:

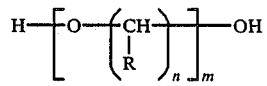

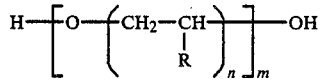

where the substituent R is hydrogen or lower alkyl containing from 1 to 5 carbon atoms including mixed substituents, and n is typically from 2 to 6 and m is from 5 to 100 or even higher. Included are poly(oxytetramethylene) glycols, poly(oxyethylene) glycols, poly(oxy-1,2-propylene) glycols and the reaction products of ethylene glycol with a mixture of 1,2-propylene oxide and ethylene oxide.

Also useful are polyether polyols formed from oxyalkylationof various polyols, for example, glycols such as ethylene glycol, 1,6-hexanediol, Bisphenol A and the like, or other higher polyols, such as trimethylolpropane, pentaerythritol and the like. Polyols of higher functionality which can be utilized as indicated can be made, for instance, by oxyalkylation of compounds such as sorbitol or sucrose. One commonly utilized oxyalkylation method is by reacting polyol with an alkylene oxide, for example, ethylene or propylene oxide, in the presence of an acidic or basic catalyst.

Polyester polyols can also be used. Polyester polyols can be prepared by the polyesterification of an organic polycarboxylic acid or anhydride thereof with organic polyols and/or an epoxide. Usually, the polycarboxylic acids and polyols are aliphatic or aromatic dibasic acids and diols.

The diols which are usually employed in making the polyester include alkylene glycols, such as ethylene glycol, neopentyl glycol and other glycols such as hydrogenated Bisphenol A, cyclohexanediol, cyclohexanedimethanol, caprolactonediol, for example, the reaction product of epsilon-caprolactone and ethylene glycol, hydroxyl-alkylated bisphenols, polyether glycols, for example, poly(oxytetramethylene)glycol and the like. Polyols of higher functionality can also be used. Examples include trimethylolpropane, trimethylolethane, pentaerythritol and the like, as well as higher molecular weight polyols such as those produced by oxyalkylating lower molecular weight polyols.

The acid component of the polyester consists primarily of monomeric carboxylic acids or anhydrides having 2 to 18 carbon atoms per molecule. Among the acids which are useful are phthalic acid, isophthalic acid, terephthalic acid, tetrahydrophthalic acid, hexahydrophthalic acid, adipic acid, azelaic acid, sebacic acid, maleic acid, glutaric acid, chlorendic acid, tetrachlorophthalic acid, decanoic acid, dodecanoic acid, and other dicarboxylic acids of varying types. The polyester may include minor amounts of monobasic acids such as benzoic acid, stearic acid, acetic acid, hydroxystearic acid and oleic acid. Also, there may be employed higher polycarboxylic acids such as trimellitic acid and tricarballylic acid. Where acids are referred to above, it is understood that anhydrides of those acids which form anhydrides can be used in place of the acid. Also, lower alkyl esters of the acids such as dimethyl glutarate and dimethyl terephthalate can be used.

Besides polyester polyols formed from polybasic acids and polyols, polylactone-type polyesters can also be employed. These products are formed from the reaction of a lactone such as epsilon-caprolactone and a polyol. The product of a lactone with an acid-containing polyol can be used.

The unplasticized polymeric material for preparation of the sealing element can be selected form the same materials which are suitable for the spacer element. Preferably the polymeric material is a polyurethane. It is also preferred that the polyurethane of the sealing element be prepared from a hydrophobic, active hydrogen containing material. Suitable materials include, for example, polybutylene oxides such as poly(1,2-butylene oxide) and hydroxyl terminated diene polymers such as hydroxyl terminated polybutadiene and hydroxyl terminated polyisoprene. Preferably the hydroxyl terminated diene polymers are utilized. Of these, hydroxyl terminated polybutadiene is preferred and hydroxyl terminated polyisoprene is most preferred. These materials are described below.

The hydroxyl functional polydiene polymers include polymers of 1,3-dienes containing from 4 to 12 and preferably from 4 to 6 carbon atoms. Typical dienes include 1,3-butadiene, 2,3-dimethyl-1,3-butadiene, 2-methyl-1,3-butadiene(isoprene) and piperylene. As was mentioned above, preferably, hydroxyl functional polymers of 1,3-butadiene or isoprene are utilized. Also, copolymers of 1,3-butadiene and a monomer copolymerizable with 1,3-butadiene such as isoprene and piperylene can be used. Other polymerizable monomers such as methyl methacrylate, acrylic acid, styrene and acrylonitrile can also be used, but their use is not preferred.

As mentioned above, the preferred hydroxyl functional polybutadiene polymers are homo- polymers of 1,3-butadiene. The polybutadienes can contain predominantly 1,2-(vinyl) unsaturation but polybutadienes containing predominantly (that is, greater than 50 and preferably greater than 60 percent) 1,4- unsaturation are preferred. Useful polybutadienes contain from about 10 to 30 percent cis 1,4-unsaturation, 40–70 percent trans 1,4-unsaturation and 10–35 percent 1,2-vinyl unsaturation.

The hydroxyl terminated polyisoprenes which have been set forth above as preferred can be prepared according to U.S. Pat. No. 3,673,168 which is incorporated by reference herein.

The polydiene polymers of the present invention are normally liquids at room temperature and preferably have number average molecular weights within the range of about 500 to 15,000, more preferably 1000 to 5000. One preferred class of polybutadiene materials are those commerically available from ARCO Chemical under the trademark designation POLY Bd. One example is the material sold under the code R-45 HT.

It should be understood that the polymers of the spacer and sealing elements of the present invention can be prepared from an isocyanate functional prepolymer which is the reaction product of an organic polyisocyanate and an active hydrogen containing material, such as, for example, the materials described above, which isocyanate functional prepolymer is then reacted with additional active hydrogen containing material. In preparing such prepolymers a molar excess of the polyisocyanate is reacted with the active hydrogen containing material so as to produce a reaction product or prepolymer that contains at least two unreacted isocyanate groups per molecule. Thus, the prepolymer contains a multiplicity of isocyanate groups which are capable of reacting with active hydrogen containing material to cure the composition. These prepolymers and methods for preparing them are well known to those skilled in the art thus they will not be discussed here.

In a preferred embodiment of the present invention the unplasticized polymeric material of the spacer element is of a different type from the unplasticized polymeric material of the sealing element.

The polymeric compositions of the spacer and sealing elements of the present invention are preferably two package compositions with the isocyanate containing component being in a different package than the active hydrogen containing material. The other components of the spacer and sealing elements can be added to either package as desired. The two packages are generally combined immediately prior to use. The amount of isocyanate and active hydrogen can vary; however, generally the ratio of isocyanate to active hydrogen equivalents ranges from about 0.2:1.0 to 1.0:0.2, preferably 0.5:1.0 to 1.0:0.5, most preferably 0.9:1.0 to 1.0:0.9. Chemical crosslinking or cure of the compositions begins to take place immediately with the reaction of the isocyanate and active hydrogen groups. Although not necessary, a catalyst is generally utilized to accelerate the reaction. Suitable catalysts include tin materials such as dibutyltin dilaurate, dimethyltin dichloride, butyltin trichloride and dimethyltin diacetate; tertiary amines and organo lead. The compositions are generally cured at ambient temperature. If desired, more elevated or reduced temperatures can be utilized. Also, if desired the glass surfaces can be preheated or cooled as well as the streams of polymer forming ingredients.

Generally gellation can be accomplished in less than 60 minutes, typically less than 30 minutes, preferably less than 10 minutes and more preferably less than 5 minutes. It should be understood that chemical cross-linking can continue for some period of time subsequent to the initial gellation until cure has been completed. Moreover, it should be understood, as is well appreciated by those skilled in the art, that the rate of cure can vary depending upon the specific type of active hydrogen functionality, the type of isocyanate, the type of catalyst selected and the amount of catalyst which is utilized.

In one embodiment the curable polymeric composition which is the spacer element comprises from about 5 percent by weight to about 90 percent by weight of a polyisocyanate, from about 5 percent by weight to about 90 percent by weight of an active hydrogen containing material and at least 5 percent by weight of a dehydrator material. In a preferred embodiment an isocyanate functional prepolymer is prepared from a polyether polyol and then ultimately cured with active hydrogen containing material, preferably an additional portion of the polyether polyol used to prepare the prepolymer. Thus, in such a preferred embodiment the spacer composition comprises from about 15 percent by weight to about 55 by weight of an isocyanate functional polyether prepolymer; from about 15 percent by weight to about 55 by weight of an active hydrogen containing material; and at least 30 percent by weight of a dehydrator material. Optionally this preferred embodiment additionally comprises from about 0.05 percent by weight to about 1 percent by weight of a glass adhesion promoter and from about 0.1 percent by weight to about 15 percent by weight of a thixotropic agent. The percentages by weight indicated herein are based upon the total weight of the composition.

In the embodiment detailed above the curable polymeric composition which is the sealing element comprises from about 5 percent by weight to about 95 percent by weight of a polyisocyanate and from about 5 percent by weight to about 95 percent by weight of a hydrophobic, active hydrogen containing material. The active hydrogen containing material should preferably be hydrophobic so that the sealing element can be substantially moisture imperveous. The polyisocyanate is preferably an isocyanate functional prepolymer, as has been described above in connection with the spacer element. In such a preferred embodiment the composition comprises from about 25 percent by weight to about 75 percent by weight of an isocyanate functional polyisoprene prepolymer, from about 25 percent by weight to about 75 percent by weight of a hydroxyl functional polyisoprene polymer and from about 5 percent by weight to about 60 percent by weight of a filler such as mica, talc, platey clays and other pigments of various particle sizes and shapes. Optionally, the composition further comprises from about 0.05 percent by weight to about 1 percent by weight of a glass adhesion promoter and from about 0.1 percent by weight to about 15 percent by weight of a thixotropic agent, the percentages being based on the total weight of the composition.

The curable polymeric compositions of the spacer and sealing elements can also contain other optional ingredients including colorants, ultraviolet light stabilizers and various additional fillers, rheology control agents and adhesion promoters.

It should be understood that although desiccant materials have been discussed in connection with the spacer composition and other fillers have been discussed in connection with the sealing composition, the invention is not intended to be thusly limited. If desired, desiccant materials can be utilized in the sealing composition either alone or in admixture with other fillers; and also, other fillers may be utilized in the spacer composition in admixture with the desiccant materials. Examples of fillers and desiccants have been discussed above in the specification.

The curable polymeric compositions of the spacer and sealing elements are very advantageous. The use of unplasticized polymeric material results in better adhesive and cohesive strength of the composition without phase separation which generally results from use of plasticizing additives. Also, the compositions have less elongation resulting in more rigidity and less sag which leads to better alignment of the sheets of the glazed unit.

The following examples are illustrative of the invention and are not intended to be limiting.

It should be noted that all of the working examples were formulated with a reduced amount of catalyst so that the cure time of the compositions would generally be about 15 to 20 minutes. This was done so that the compositions could be properly evaluated. One skilled in the art readily appreciates that in order to accelerate the cure to less than 10 minutes one can increase the level of catalyst accordingly.

EXAMPLE I

Preparation of a Spacer Element

| Ingredients | Parts by Weight (grams) |
|---|---|
| Component A: isocyanate component[1] | 94.65 |
| Component B: polyol component[2] | 55.35 |

[1]The isocyanate component was prepared in the following manner:

| Ingredients | Parts by Weight (grams) |
|---|---|
| isocyanate prepolymer[a] | 100.00 |
| molecular sieve[b] | 111.10 |
| BENTONE 38[c] | 3.25 |
| black tint[d] | 0.22 |

[a]The isocyanate prepolymer was prepared in the following manner:

| Charge | Ingredients | Parts by Weight (grams) |
|---|---|---|
| I | DESMODUR W[(ii)] | 4012.80 |
| II | dibutyltin dilaurate | 3.96 |
| III | 2-ethyl hexanoic acid | 3.96 |
| IV | NIAX 1025[(iii)] | 3907.20 |

[(ii)]This aliphatic diisocyanate is dicyclohexylmethane diisocyanate and it is commercially available from Mobay Chemical Corporation.

[(iii)]This polypropyleneoxide diol has a molecular weight of 1000 and a hydroxyl number of 111 and is commerically available from Union Carbide.

A suitably equipped reactor vessel was charged with (I), (II) and (III) at ambient temperature under nitrogen atmosphere. Charge (IV) was added over approximately a two hour period followed by heating to 80° C. The reaction mixture was held at 80° C. for about one hour and then cooled to room temperature. The mixture was held under a nitrogen atmosphere overnight and then sampled for isocyanate equivalent weight.

The resultant product had an isocyanate equivalent weight of 353.8.

[b]This dehydrating material is potassium sodium alumino silicate and is commercially available from Union Carbide as Molecular Sieve Type 3A.

[c]The rheological additive is an organophilic clay commercially available from NL Industries.

[d]This tint is carbon black in a petroleum plasticizer which is commerically available from Akron Chemical Company as AKROSPERSE Black E-8653 Paste.

The isocyanate component was prepared by combining the

-continued

Preparation of a Spacer Element ingredients in the order listed with mild agitation.

[2]The polyol component was prepared in the following manner:

| Ingredients | Parts by Weight (grams) |
|---|---|
| NIAX 425[e] | 15.90 |
| NIAX LG 650[f] | 15.90 |
| JEFFAMINE D400[g] | 15.90 |
| JEFFAMINE T5000[h] | 15.90 |
| A-llOO[i] | 2.16 |
| molecular sieve[j] | 78.26 |
| THIXIN R[k] | 3.66 |

[e]This polypropylene oxide diol has a molecular weight of 425 and a hydroxyl number of 263 and is commerically available from Union Carbide.

[f]This glycerine started polypropylene oxide triol has a molecular weight of 260 and a hydroxyl number of 650 and is commercially available from Union Carbide.

[g]This amine terminated polypropylene glycol has a molecular weight of approximately 400 and is commercially available from Texaco Chemical Corporation.

[h]This polyoxyalkylene triamine has molecular weight of approximately 5000 and is commercially available from Texaco Chemical Corporation.

[i]This is gamma-aminopropyltriethoxy silane commercially available from Union Carbide.

[j]This has been detailed in footnote [b], above.

[k]This thickener is an organic derivative of castor oil and is commercially available from NL Chemicals.

The polyol component was prepared by combining the ingredients in the order listed with mild agitation.

The spacer element was prepared by combining the components A and B as indicated. The mix ratio was 1.7 parts of component A to 1 part of component B.

EXAMPLE II

Preparation of a Sealing Element

| Ingredients | Parts by Weight (grams) |
|---|---|
| Component A: isocyanate component[3] | 27.78 |
| Component B: polyol component[4] | 72.22 |

[3]The isocyanate component was prepared in the following manner:

| Ingredients | Parts by Weight (grams) |
|---|---|
| isocyanate prepolymer[1] | 417.45 |
| micro mica[m] | 104.36 |
| black tint[n] | 5.22 |

[1]The isocyanate prepolymer was prepared in the following manner:

| Charge | Ingredients | Parts by Weight (grams) |
|---|---|---|
| I | MONDUR M[(iv)] | 2566.0 |
| II | dibutyltin dilaurate | 4.0 |
| III | 2-ethylhexanoic acid | 4.0 |
| IV | R45HT[(v)] | 5434.0 |

[(iv)]This is 4,4' diphenylmethane diisocyante which is commercially available from Mobay Chemical Corp.

[(v)]This hydroxyl terminated polybutadiene has a molecular weight of about 2000 to 3000 and a hydroxyl value of about 0.83 milliequivalents/gram and is commerically available from Arco Chemicals.

A suitably equipped reactor vessel was charged with (I), (II) and (III) and heated to 50° C. under a nitrogen atmosphere. Charge (IV) was added over a four hour period and the reaction mixture heated to 80° C. The resultant reaction mixture was then held at 80° C. for one hour and forty-five minutes. The resultant material had an isocyanate equivalent weight of 509.8.

[m]This is commercially available from the English Mica Company as Micromica C-1000.

[n]This has been detailed above in footnote [d].

The isocyanate component was prepared by combining the ingredients in the order listed with mild agitation.

[4]The polyol component was prepared in the following manner:

-continued

Preparation of a Sealing Element

| Ingredients | (grams) |
|---|---|
| polyol mixture[o] | 150.0 |
| THIXIN R[p] | 4.0 |

[o]The polyol mixture was prepared in the following manner:

| Ingredients | Parts by Weight (grams) |
|---|---|
| R45HT | 2000 |
| micro mica | 1330 |
| A-1100 | 22 |

The above ingredients were combined with mild agitation.

[p]This thickener has been detailed above in footnote [k].

The polyol component was prepared by combining the polyol mixture and thickener with mild agitation.

The sealing element was prepared by combining the components A and B as indicated. The mix ratio was 1 part of component A to 2.6 parts of component B.

EXAMPLE III

This example also illustrates the preparation of a sealing element according to the present invention. The sealing element of this example is similar to that of Example II, above, except that the mix ratio of components A and B is different. In this example, the mix ratio was 1 part of component A to 3.3 parts of component B.

EXAMPLE IV

This example also illustrates the preparation of a sealing element according to the present invention. The sealing element of this example is similar to that of Example II, above, except that the mix ratio of components A and B is different. In this example, the mix ratio was 1 part of component A to 2.8 parts of component B.

EXAMPLE V

In this example the spacer and sealing compositions detailed above were evaluated for moisture vapor transmission rate and tensile strength and tensile elongation. The tensile strength and tensile elongation were determined for the bulk polymeric material as well as for bonds prepared between glass plates.

The moisture vapor transmission rate was determined according to ASTM F-372-78 and the results standardized for a one millimeter thick sample.

The tensile strength and elongation for the bulk material were determined according to ASTM D-638 modified by using an ASTM D-412 type C die. The cross-head speed was 0.5 inch per minute (12.7 millimeters/-min).

Figure 3:
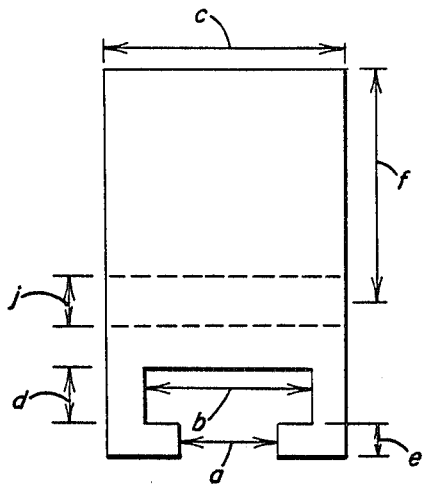
FIG. 3 is a side elevational view of a special fixture utilized in conjunction with an INSTRON apparatus to measure tensile bond strength of a composition between two glass plates.
Figure 4:
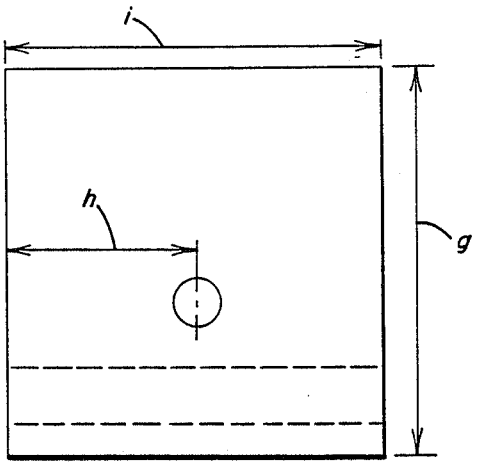
FIG. 4 is a front elevational view of the special fixture shown in FIG. 3.

The tensile bond strength and elongation of the glass bonds were determined according to ASTM D-952-51. The cross head speed was 0.5 inch per minute (12.7 millimeters/min). However, because bond strength was measured between two glass plates it was necessary to modify the INSTRON apparatus used for measuring the bond strength. A special fixture was constructed to hold the glass plates so that they could be pulled on the INSTRON without fracturing the glass. This fixture is shown in FIG. 3 and FIG. 4. FIG. 3 is a side elevational view and FIG. 4 is a front elevational view. The dimensions are shown in Table II.

The films for testing of the bulk polymeric material were prepared in the following manner. The polyol and isocyanate components for each composition were combined in vacuo in order to eliminate any air which might be trapped during mixing. A TEFLON ® fluoropolymer sheet of a desired thickness was overlaid with another similar sheet having an orifice cut into the center of the sheet. A sample of the composition to be evaluated was placed in the orifice and a third TEFLON® fluoropolymer sheet of the same dimensions was placed over top. The sandwiched sheets so assembled were placed in a heated press and subjected to pressure at 150° F. (66° C.) for 45 minutes. The resultant free film which was removed from between the sheets was used for testing. From this free film samples were cut for testing. Only portions of the film were utilized which appeared to be free of defects. The sample was then sandwiched between two aluminum foil sheets having an orifice in the center of the sheets and tested for moisture vapor transmission rate. Samples for bulk tensile strength and elongation were cut using the D412 type C die and tested.

The glass bonds were prepared in the following manner:

Two pieces of glass measuring 3 inches×1 inch×¼ inch (76.2 mm×25.4 mm×6.4 mm) were cleaned with a commercially available glass cleaner to remove any dirt, dust or grease present. A preassembled mold, held together with adhesive tape and measuring 2 inches×½ inch×½ inch (50.8 mm×12.7 mm×12.7 mm) was placed on one of the pieces of glass. Each composition was prepared by mixing components A and B together (a total of 40 grams of material for each bond) for approximately 45 seconds to 1 minute and then the composition was placed in the mold. The mold was slightly overfilled to assure complete contact of the composition with both glass surfaces. The second piece of glass was then positioned over the filled mold in register with the first piece of glass and the entire arrangement was held in place with a metal clip until the compositions cured. The sealer bonds were cured for 24 hours while the spacer bonds were cured for 48 hours.

After the bonds cured the molds were removed and the bonds were evaluated according to the ASTM test and using the special fixture to hold the glass plates in the INSTRON apparatus.

The results are set out below.

| | | Bulk | | Glass Bonds | |
|---|---|---|---|---|---|
| Composition | MVT gmm/dm² | Tensile Strength (psi) | Elongation (percent) | Tensile Strength (psi) | Elongation (percent) |
| Example I | 74.0 | 731 | 148 | 480 | 13 |
| Example II | 9.7 | 593 | 61 | 87 | 17 |
| Example III | 7.6 | 424 | 81 | 70 | 14 |
| Example IV* | 9.4 | 499 | 75 | 91 | 18 |

*For this example the MVT was an average of four separate determinations and the tensile bond strength and elongation were an average of two separate determinations. The variation in measurements is believed to be due to film defects.

EXAMPLE VI

This example illustrates the preparation and evaluation of a spacer composition using a polyester polyol rather than a polyether polyol.

| Ingredients | Parts by Weight (gram) |
|---|---|
| Component A: isocyanate component[5] | 7.2 |
| Component B: polyol component[6] | 12.8 |

[5]The isocyanate component was prepared in the following manner:

| Ingredients | Parts by Weight (grams) |
|---|---|
| isocyanate prepolymer[r] | 150.00 |
| molecular sieve[s] | 150.00 |

[r]The isocyanate prepolymer was prepared in the following manner:

| Charge | Ingredients | Parts by Weight (grams) |
|---|---|---|
| I | DFSMODUR W | 260.00 |
| II | 2-ethylhexanoic acid | 0.30 |
| III | dibutyltin dilaurate | 0.30 |
| IV | LEXOREZ 1100-45[(vi)] | 340.00 |

[(vi)]This glycol adipate based polyester polyol had a hydroxyl number of 45 and a functionality of 2 and is commercially available from Inolex Chemical Company.

A suitable equipped reactor vessel was charged with (I), (II) and (III) at ambient temperature under a nitrogen atmosphere. Charge (IV) was added over approximately a three hour period. The reaction mixture was then held at ambient temperature under nitrogen atmosphere for approximately two hours and sampled for isocyanate equivalent weight. The resultant product had an isocyanate equivalent weight of 354.3.

[s]This has been detailed in footnote [b], above.

The polyol component was prepared by combining the ingredients with mild agitation.

The isocyanate component was prepared by combining the ingredients together with mild agitation.

[6]The polyol component was prepared in the following manner:

| Ingredients | Parts by Weight (grams) |
|---|---|
| LEXOREZ 1842-90[t] | 50.0 |
| molecular sieve[u] | 50.0 |

[t]This crosslinked glycol adipate based polyester has a hydroxyl number of 90 and a functionality of 3.1 and is commercially available from Inolex Chemical Company.

[u]This has been detailed above in footnote [b].

The polyol component was prepared by combining the ingredients with mild agitation The spacer element was prepared by combining the components A and B as indicated. The mix ratio was 1 part of component A to 1.8 parts of component B.

The components had an average tensile bond strength of 135 psi and an elongation of 4.5 percent.

EXAMPLE VII

This example illustrates the preparation sealing composition of the invention utilizing a polyisoprene olyol instead of a polybutading polyol.

| Ingredients | Parts by Weight (grams) |
|---|---|
| Component A: isocyanate component[7] | 11.00 |
| Component B: polyol component[8] | 17.78 |

[7]The isocyanate component was prepared in the following manner:

| Charge | Ingredients | Parts by Weight (grams) |
|---|---|---|
| I | MONDUR M | 204.00 |
| II | dibutyltin dilaurate | 0.30 |
| III | 2-ethylhexanoic acid | 0.30 |
| IV | hydroxyl functional polyisoprene[(v)] | 396.00 |

[(v)]This hydroxyl terminated polyisoprene had a molecular weight of about 2000 to 3000 and a hydroxyl value of about 0.90 milliequivalents/gram. It was obtained fron ARCO and can be prepared according to U.S. Pat. No. 3,673,168.

A suitably equipped reactor vessel was charged with (I), (II) and (III) at ambient temperature under a nitrogen atmoshpere and heated to 50° C. Charge (IV) was preheated slightly and added over approximately a two hour period. The reaction mixture was held at 65° C. for about one hour, cooled and sampled for-isocyanate equivalent weight. The resultant product had an isocyanate equivalent weight of 518.9.

[8]The polyol component was prepared from 17.50 parts by weight of hydroxyl functional polyisoprene and 0.28 parts by weight of 2.4-pentanedione. The pentanedione was added as cure retardant so that the sealing composition could be evaluated for MVT. Without the retardant the rate of cure was such that gellation occured -continued before a film for determination of MVT could be prepared.

The sealing composition was prepared by combining the components A and B as indicated. The MVT of this sealing composition was 6.21 gmm/m²d.

EXAMPLE VIII

This example is similar to Example VII with the exception that the composition also contained micro mica filler at a level of 25 percent based on the amount of hydroxyl functional polyisoprene and isocyanate component.

| Ingredients | Parts by Weight (grams) |
|---|---|
| Component A: isocyanate component[9] | 11.00 |
| Component B: polyol component[10] | 27.28 |

[9]This was exactly as has been set forth above in footnote [7].
[10]The polyol component was prepared from 17.50 parts by weight of hydroxyl functional polyisoprene, 0.28 parts by weight of 2,4-pentanedione and 9.50 parts by weight of micro mica as detailed in footnote [m].

The sealing composition was prepared by combining the components A and B as indicated. The MVT of this sealing composition was 5.94 gmm/m²d.

EXAMPLE IX

This example illustrates the preparation and evaluation of a spacer composition prepared with a polysulfide resin.

| | Ingredients | Parts by Weight (grams) |
|---|---|---|
| Component A: | isocyanate polymer[11] | 7.40 |
| | DESMODUR N-100[12] | 5.69 |
| Component B: | Thiokol LP-3[w] | 26.9 |
| | molecular sieve[13] | 40.0 |
| | organolead catalyst[14] | 0.4 |

[11]The isocyanate prepolymer was prepared in the following manner:

| Charge | Ingredients | Parts by Weight (grams) |
|---|---|---|
| I | DESMODUR W | 331.1 |
| II | 2-ethyl hexanoic acid | 0.3 |
| III | dibutyltin dilaurate | 0.3 |
| IV | Thiokol LP-3 | 318.9 |

[w]This polysulfide polymer is a polymer of bis(ethylene oxy) methane containing disulfide linkages. It has an average molecular weight of 1000 and a mercaptan content of 5.9 to 7.7 percent. It is commercially available from Morton Thiokol under the code designation LP-3.
A suitably equipped reactor vessel was charged with (I), (II) and (III) at room temperature and placed under nitrogen atmosphere. Charge (IV) was then added over approximately 75 minutes. The reaction mixture was then heated to 80° C. and held at this temperature for 2 hours and 30 minutes until an isocyanate equivalent weight of about 343 was attained.
[12]This liquid aliphatic polyisocyanate has an average isocyanate equivalent weight of 191 and is commercially available from Mobay Chemicial Corporation.
[13]This molecular sieve has been detailed above in footnote [b].
[14]This organo lead compound is commercially available from Tenneco as Pb Nuxtra. It contains 36 percent lead by weight.

Components A and B were prepared by combining the ingredients in the order listed. The spacer composition was then prepared by combining Components A and B.

The resultant spacer composition had an MVT of 57.08 gum/dm².

EXAMPLE X

This Example is similar to Example VII.

| Ingredients | Parts by Weight (grams) |
|---|---|
| Component A: isocyanate component[15] | 17.09 |
| Component B: polyol component[16] | 27.90 |

[15]The isocyanate component was prepared in the following manner:

| Charge | Ingredients | Parts by Weight (grams) |
|---|---|---|
| I | MONDUR M | 408.0 |
| II | dibutyltin dilaurate | 0.6 |
| III | 2-ethylhexanoic acid | 0.6 |
| IV | hydroxyl functional isoprene | 792.0 |

The isocyanate prepolymer was prepared as has been detailed above in Example VII, footnote [7]. The result product had an isocyanate equivalent weight of 505.
The isocyanate component was prepared by combining 11.64 parts by weight of the above isocyanate prepolymer and 5.45 parts by weight of micromica detailed in footnote [m].
[16]The polyol component was prepared by combining 19.81 parts by weight of hydroxyl functional polyisoprene, 8.07 parts by weight of C-1000 micromica anc 0.023 parts by weight of 2-ethylhexanoic acid. The acid was added as a cure retardant for the same reasons as 2,4-pentanedione was added in Example VII, footnote [8].

The sealing composition was prepaded by combining components A and B as indicated with agitation. The composition had an MvT of 4.44 gmm/m²d.

EXAMPLE XI

This example illustrates the preparation of a sealing composition and an evaluation of its tensile bond strength and lap shear strength.

| Ingredients | Parts by Weight (grams) |
|---|---|
| Component A: isocyanate component[17] | 13.42 |
| Component B: polyol component[18] | 26.58 |

[17]The isocyanate component was prepared in the following manner:

| Ingredients | Parts by Weight (grams) |
|---|---|
| isocyanate prepolymer of fn [15] | 72.87 |
| micromica of fn [m] | 18.17 |
| black tint of fn [d] | 1.58 |

The above ingredients were combined with agitation.
[18]The polyol component was prepared in the following manner:

| Ingredients | Parts by Weight (grams) |
|---|---|
| hydroxyl functional isoprene | 118.33 |
| micromica of fn [m] | 82.00 |
| A-1100 | 1.41 |
| THIXIN R | 5.64 |

The above ingredients were combined with agitation.

The sealing composition was prepared by combining the components A and B as indicated. The mix ratio was 1 part of Component A to 1.98 pars of Component B.

The aforedescribed sealing composition was evaluated for tensile bond strength and lap shear strength. The tensile bond strength was determined as has been detailed above.

Figure 5:
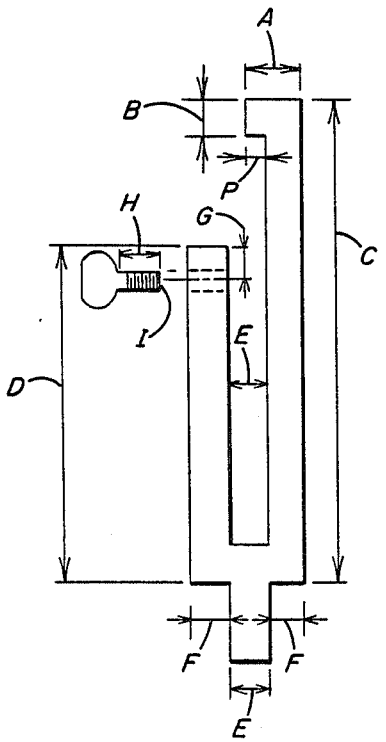
FIG. 5 is a side elevational view of a special fixture utilized in conjunction with an INSTRON apparatus to measure lap shear strength of a composition between two glass plates.
Figure 6:
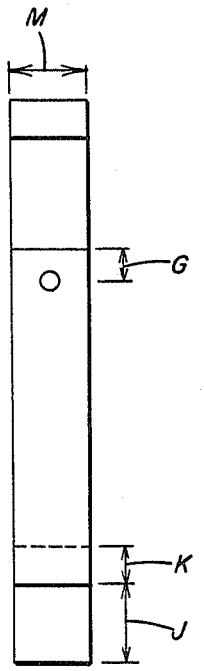
FIG. 6 is a front elevational view of the special fixture shown in FIG. 5.

The lap shear strength was determined according to ASTM D-1002. The cross head speed was 0.5 inch per minute (12.7 mm/minute). However, because lap shear bond strength was measured between two glass plates, it was necessary to modify the INSTRON apparatus used for measuring the bond strength. A special fixture was constructed to hold the glass plates so that they could be pulled on the INSTRON without fracturing the glass plates. This fixture is shown as FIG. 5 and FIG. 6. FIG. 5 is a side elevational view and FIG. 6 is a front elevational view. The dimensions are shown in Table III.

The glass bonds for lap shear testing were prepared as has been described above for the determination of tensile bond strength with the following exceptions:

The two pieces of glass measured 4 inches × 1 inch × ¼ inch (101.6 mm × 25.4 mm × 6.35 mm).

The preassembled mold measured 1 inch × ½ inch × ½ inch (25.4 mm × 12.7 mm × 12.7 mm).

The mold was positioned 2/5 inch (10.16 mm) away from the edge of one of the glass plates. After the mold was filled (slightly overfilled), the second piece of glass was positioned over the first Piece so that only a 1 3/10 inch (33.02 mm) section of both of the panels overlapped and the mold was in the center of the overlapping section.

The aforedescribed sealing composition had a tensile bond strength of 104 psi and a lap shear strength of 38 psi (These values represent an average of two separate determinations.)

EXAMPLE XII

This example illustrates the preparation of a sealing composition and an evaluation of its tensile bond strength and lap shear strength.

| Ingredients | Mix Ratio |
|---|---|
| Component A: isocyanate component[19] | 1 |
| Component B: polyol coponent[20] | 2.62 |

[19]The isocyanate coponent was prepared in the following manner:

| Ingredients | Parts by Weight (grams) |
|---|---|
| isocyanate prepolymer of fn [1] | 784.78 |
| micromica of fn [m] | 196.20 |
| black tint of fn [d] | 19.02 |

[20]The polyol component was prepared in the following manner:

| Ingredients | Parts by Weight (grams) |
|---|---|
| R 45 HT | 1743.19 |
| micromica of fn [m] | 1159.46 |
| A-1100 | 19.39 |
| THIXIN R | 77.96 |

A and B were prepared by combining the ingredients in the order listed. The sealing composition was then prepared by combining components A and B in the indicated proportions.

The resultant sealing composition had a tensile bond strength of 74 psi and a lap shear strength of 22 psi. (These values represent an average of two separate determinations).

EXAMPLE XIII

This example illustrates the preparation of a spacer composition and an evaluation of its tensile bond strength and lap shear strength.

| Ingredients | Mix Ratio |
|---|---|
| Component A: Isocyanate component[21] | 1.86 |
| Component B: Polyol component[22] | 1.00 |

[21]The isocyanate component was prepared in the following manner:

| Ingredients | Parts by Weight (grams) |
|---|---|
| isocyante prepolymer of footnote [a] | 462.80 |
| molecular sieve of footnote [b] | 514.18 |

-continued

| | |
|---|---|
| Bentone BD-2[x] | 15.08 |
| black tint of footnote [d] | 7.93 |

[x]This rheological additive is an organophilic clay which is commercially available from NL Industries.

[22]The polyol component was prepared in the following manner:

| Ingredients | Parts by Weight (grams) |
|---|---|
| NIAX 425 | 163.90 |
| NIAX LG650 | 163.90 |
| JEFFAMINE D-400 | 163.90 |
| JEFFAMINE T-5000 | 163.90 |
| molecular sieve of footnote [b] | 806.67 |
| THIXIN R | 37.71 |

Components A and B aware prepared by combining the ingredients in the order listed above. The spacer composition was then prepared by combining components A and B in the indicated proportions.

The resultant spacer composition had a tensile bond strength of 588 psi and a lap shear strength of 215 psi. (These values represent an average of two separate determinations).

TABLE II

| FIG. 3 and FIG. 4 Dimension | inches | (millimeters) |
|---|---|---|
| a | 0.625 | 15.875 |
| b | 1.125 | 28.575 |
| c | 1.56 | 39.624 |
| d | 0.375 | 9.525 |
| e | 0.188 | 4.775 |
| f | 1.50 | 38.10 |
| g | 2.50 | 63.50 |
| h | 1.25 | 31.75 |
| i | 2.50 | 63.50 |
| j | 0.312 | 7.925 |

TABLE III

| FIG. 5 and FIG. 6 Dimension | inches | (millimeters) |
|---|---|---|
| A | 0.7 | 17.78 |
| B | 0.5 | 12.70 |
| C | 6.5 | 165.10 |
| D | 4.45 | 113.03 |
| E | 0.375 | 9.525 |
| F | 0.50 | 12.70 |
| G | 0.45 | 11.43 |
| H | 1.0 | 25.40 |
| I | 0.375 | 9.525 |
| J | 1.0 | 25.40 |
| K | 0.5 | 12.70 |
| M | 1.0 | 25.40 |

What is claimed is:

1. In a multiple glazed unit comprising a pair of glass sheets maintained in spaced-apart relationship to each other by a spacer element to provide a gas space therebetween and a sealing element to hermetically seal the gas space, wherein the improvement comprises a spacer element comprising a dehydrating material and an unplasticized polymeric material which is the reaction product of a polyisocyanate and an active hydrogen containing material; and a sealing element comprising an unplasticized polymeric material which is the reaction product of a polyisocyanate and an active hydrogen containing material, the polymeric material of the spacer element having a moisture vapor transmission rating which is greater than that of the polymeric material of the sealing element.

2. The multiple glazed unit of claim 1 wherein the polymeric material of the spacer element is different from the polymeric material of the sealing element.

3. The multiple glazed unit of claim 1 wherein the dehydrating material is present in the spacer element in an amount ranging from about 10 percent by weight to about 75 percent by weight, the percentages being based on the total weight of the components making up the spacer element.

4. The multiple glazed unit of claim 1 wherein the unplasticized polymeric material of the spacer and sealing elements is selected from polyurethanes, polyureas, poly(urethane-ureas), polythiocarbamates and mixtures thereof.

5. The multiple glazed unit of claim 4 wherein the unplasticized polymeric material of the spacer element and sealing element is a polyurethane.

6. The multiple glazed unit of claim 5 wherein the polyurethane of the sealing element is prepared from a polydiene polyol and a polyisocyanate.

7. The multiple glazed unit of claim 1 wherein the spacer element is self-adhered to the marginal edge periphery of the inner, facing surfaces of the glass sheets inboard of the sealing element, and is characterized by a moisture vapor permeability or transmission rate of at least about 1 gmm/dm$^2$ as determined by the ASTM F-372-78.

8. The multiple glazed unit of claim 1 wherein the sealing element is self-adhered to the marginal edge periphery of the inner, facing surfaces of the glass sheets and is characterized by a moisture vapor permeability or transmission rate of no greater than about 10 gmm/dm$^2$ as determined by the ASTM F-372-78.

9. The multiple glazed unit of claim 8 wherein the sealing element is characterized by a shear strength of at least about 10 pounds per square inch as determined by ADTM D-1002, a tensile strength of at least about 20 pounds per square inch and an elongation at break of at least about 2 percent as determined by ASTM D-952.

10. The multiple glazed unit of claim 1 wherein the sealing element further comprises a filler.

11. The multiple glazed unit of claim 5 wherein the unplasticized polyurethane of the sealing element is prepared from polyisoprene and a polyisocyanate.

12. The multiple glazed unit of claim 5 wherein the unpla polyurethane of the sealing element is prepared from hydroxyl functional polybutadiene and a polyisocyanate.

13. The multiple glazed unit of claim 5 wherein the unplasticized polyurethane of the spacer element is prepared from a polyether polyol and a polyisocyanate.

14. The multiple glazed unit of claim 10 wherein the filler is present in the sealing element in an amount ranging from about 5 percent by weight to about 60 percent by weight, the percentages being based on the total weight of the components making up the sealing element.

15. In a multiple gazed unit comprising a pair of glass sheets maintained in spaced-apart relationship to each other by a spacer element to provide a gas space therebetween and a sealing element to hermetically seal the gas space, wherein the improvement comprises a spacer element comprising a dehydrating material and an unplasticized polymeric material which is the reaction product of a polyisocyanate and an active hydrogen containing material, said spacer element being self adhered to the marginal edge periphery of the inner facing surfaces of the glass sheets inboard of the sealing element, the spacer element being characterized by a shear strength of at least about 10 pounds per square inch as determined by ASTM D-1002, a tensile bond strength of at least about 20 pounds per square inch and an elongation at break of at least about 2 percent as determined by ASTM D-952; and a sealing element comprising an unplasticized polymeric material which is the reaction product of a polyisocyanate and an active hydrogen containing material, the polymeric material of the spacer element having a moisture vapor permeability or transmission rate of at least about 1 gmm/dm$^2$ as determined by ASTM F-372-78 which is greater than that of the polymeric material of the sealing element.

16. In a multiple glazed unit comprising a pair of glass sheets maintained in spaced-apart relationship to each other by a spacer element to provide a gas space therebetween and a sealing to hermedically seal the gas space, wherein the improvement comprises a spacer element comprising a dehydrating material, a filler and an unplasticized polymeric material which is the reaction product of polyisocyanate and an active hydrogen containing material; and a sealing element comprising an unplasticized polymeric material which is the reaction product of a polyisocyanate and an active hydrogen containing material, the polymeric material of the spacer element having a moisture vapor transmission rating which is greater than that of the polymeric material of the sealing element.

17. in a multiple glazed unit comprising a pair of glass sheets maintained in spaced-apart relation ship to each other by a spacer element to provide a gas space therebetween and a sealing element to hermetically seal the as space, wherein the improvement comprises a spacer element comprising a dehydrating material, a molecular sieve filler and an unplasticized polymeric material which is the reaction product of polyisocyanate and an active hydrogen containing material; and a sealing element comprising an unplasticized polymeric material which is the reaction product of a polyisocyanate and an active hydrogen containing material, the polymeric material of the spacer element having a moisture vapor transmission rating which is greater than that of the polymeric material of the sealing element.

18. In a multiple glazed unit comprising a pair of glasssheets maintained in spaced-apart relationship to each other by a spacer element to provide a gas space therebetween and a sealing element to hermetically seal the gas space, wherein the improvement comprises a spacer element comprising a dehydrating material and an unplasticized polymeric material which is the reaction product of a polyisocyanate and an active hydrogen containing material; and a sealing element comprising mica filler and an unplasticized polymeric material which is the reaction product of a polyisocyanate and an active hydrogen containing material, the polymeric material of the spacer element having a moisture vapor transmission rating which is greater than that of the polymeric material of the sealing element.

19. In a multiple glazed unit comprising a pair of glass sheets maintained in spaced-apart relationship to each other by a spacer element to provide a gas space therebetween and a sealing element to hermetically seal the gas space, wherein the improvement comprises a spacer element comprising a dehydrating material, at least 5 percent by weight of a filler, the percentage being based on the total weight of the components making up the spacer element, and an unpalsticized polymeric material which is the reaction product of a polyisocyanate and an active hydrogen containing material; and a sealing element comprising an unplasticized polymeric material which is the reaction product of a polyisocynate and an active hydrogen containing material, the polymeric material of the space element having a moisture vapor transmission rating which is greater than that of the polymeric material of the sealing element.

* * * * *

UNITED STATES PATENT AND TRADEMARK OFFICE

CERTIFICATE OF CORRECTION

PATENT NO. : 4,807,419

DATED : February 28, 1989

INVENTOR(S) : Robert B. Hodek, James A. Meiere, James E. Jones and Jerome A. Seiner It is certified that error appears in the above-identified patent and that said Letters Patent is hereby corrected as shown below:

In the Claims, column 19, line 46, "unpla" should read --unplasticized--;

column, 19, line 58, "gazed" should read --glazed--;

column 20, line 17, "hermedically" should read --hermetically--;

column 20, line 21, --a-- should be inserted before "polyisocyanate";

column 20, line 33, "as" should read --gas--;

column 20, line 45, "glasssheets" should read --glass sheets--.

Signed and Sealed this

Thirty-first Day of August, 1993

Bruce Lehman

*Attest:*

BRUCE LEHMAN

*Attesting Officer*

*Commissioner of Patents and Trademarks*